US007033155B2

(12) United States Patent
Hinzpeter et al.

(10) Patent No.: US 7,033,155 B2
(45) Date of Patent: Apr. 25, 2006

(54) HYDRAULIC PRESS FOR COMPRESSING METALLIC POWDER

(75) Inventors: Jürgen Hinzpeter, Schwarzenbek (DE); Ulrich Zeuschner, Schwarzenbek (DE); Ingo Schmidt, Schwarzenbek (DE); Thomas Pannewitz, Schwarzenbek (DE); Udo Baltruschat, Hamburg (DE); Thorsten Ehrich, Hamburg (DE); Ulf Hauschild, Hamburg (DE)

(73) Assignee: Fette GmbH, Schwarzenbek (DE)

( * ) Notice: Subject to any disclaimer, the term of this patent is extended or adjusted under 35 U.S.C. 154(b) by 179 days.

(21) Appl. No.: 10/225,599

(22) Filed: Aug. 22, 2002

(65) Prior Publication Data

US 2003/0041749 A1 Mar. 6, 2003

(30) Foreign Application Priority Data

Aug. 31, 2001 (DE) ..... 101 42 773

(51) Int. Cl.
*B29C 43/02* (2006.01)

(52) U.S. Cl. ..... 425/78; 425/149; 425/150; 425/355; 425/DIG. 58

(58) Field of Classification Search ..... 425/78, 425/149, 150, 352, 355, DIG. 58
See application file for complete search history.

(56) References Cited

U.S. PATENT DOCUMENTS

| | | | | |
|---|---|---|---|---|
| 3,890,413 | A * | 6/1975 | Peterson | 425/78 |
| 4,260,346 | A | 4/1981 | Anderson, Jr. et al. | 425/78 |
| 4,946,634 | A * | 8/1990 | Shaner | 425/149 |
| 5,043,111 | A * | 8/1991 | Hinzmann et al. | 425/150 |
| 6,432,158 | B1 * | 8/2002 | Harada et al. | 425/78 |

FOREIGN PATENT DOCUMENTS

JP 07-266086 * 10/1995

* cited by examiner

*Primary Examiner*—Duane Smith
*Assistant Examiner*—Thu Khanh T. Nguyen
(74) *Attorney, Agent, or Firm*—Vidas, Arrett & Steinkraus

(57) ABSTRACT

A hydraulic press for compressing metallic powder or the like to form compacts, comprising a die-plate, an upper ram, and at least one lower ram which interact with a die-bore and are operable each by a dual-action hydraulic press cylinder, whereby a limited dead path length is provided for the return stroke in the force path between the press cylinder and the upper ram in which the upper ram is not carried along, and that a separate pressure generator producing a variable pressure is arranged in parallel with the force path via which a compression force is produced on the upper ram during the dead path length.

5 Claims, 2 Drawing Sheets

HYDRAULIC PRESS FOR COMPRESSING METALLIC POWDER

CROSS REFERENCE TO RELATED APPLICATIONS

Not Applicable.

STATEMENT REGARDING FEDERALLY SPONSORED RESEARCH

Not applicable.

BACKGROUND OF THE INVENTION

The manufacture of tools, e.g. cutting blades for milling or drilling, is frequently performed by a sintering process. Before undergoing sintering, compacts are formed from metallic powder. An eccentric press or hydraulic press is used to press the metallic powder into shape. The invention relates to a powder hydraulic press.

The upper and lower rams are operated by means of appropriate press cylinders in a powder hydraulic press. It is not only necessary to apply a considerable pressure by means of the press cylinders, but the rams also require to be moved to a predetermined position each in order to avoid damage, on one hand, and ensure desired reproducible dimensions for the compact, on the other.

Powder presses of this type are known to measure both the length passed through by the rams and the force which is applied. This way makes it possible to ensure a desired compaction with dimensions being predetermined. To measure forces, it is known to arrange a load cell between the press cylinder and the ram.

Once the rams have taken their predetermined positions and the maximum compression force is reached the press cylinders undergo a reversal of their motion and it is specifically the upper ram which is moved out of the die-bore to enable the compact to be ejected by means of the lower ram.

As is further known the sudden relief of the compression power is disadvantageous. The compact exhibits a certain spring-back behaviour and there is a risk of undesirable cracks forming in the compact during the spring-back, which have an adverse effect in sintering and cause defective compacts. When the compression power is removed it is known to maintain a so-called live load, e.g. by means of a spring. A spring, however, has only one predetermined characteristic line.

During pressure relief, it is also imaginable to jointly displace the lower and upper rams in a way to produce a certain live load which gradually decreases. The existing hydraulic press cylinders, however, make it nearly impossible to obtain a harmonized motion of the upper and lower rams.

It is the object of the invention to provide a hydraulic press for compressing metallic powder or the like to form compacts wherein a controlled spring-back of the compact becomes possible.

BRIEF SUMMARY OF THE INVENTION

The inventive hydraulic press provides for a limited dead path length for the return stroke in which the upper ram is not carried along, in the force path between the press cylinder and the upper ram. If the press cylinder is operated to move in the opposite direction after the maximum compression force or the predetermined position of the upper ram is reached the cylinder will not carry along the upper ram over a first length of the path. If no particular provisions were made the compact would then be loaded by the weighting force of the upper ram. According to the invention, however, a separate pressure generator producing a variable pressure is provided which is arranged in parallel with the force path and produces a predetermined compression force on the upper ram during the aforementioned dead path length. The compression force may be led towards zero along a desired line and will be zero, for example, at the moment when the upper ram is carried along by the press cylinder during the return stroke.

The advantage of the inventive press is that a controlled live load acts onto the compact so as to efficiently prevent cracks from forming on the compact. The live load may be slowly decreased by means of the invention. In addition, there is the advantage that a predetermined live load may be adjusted depending on the material and geometry of the compact. Finally, there is obtained the advantage that the invention allows to reveal the forces acting onto the compact after the compression procedure.

According to an aspect of the invention, the pressure generator acts onto the upper ram via a force measuring device. The force measuring device helps in setting up a regulation with a view to regulating the course of the live load acting on the upper ram by means of predetermined values. The pressure generator preferably is a dual-action pneumatic cylinder. A dual action of the pneumatic cylinder is desirable to enable the cylinder to compensate the weighting force on the upper ram partially or completely.

To permit a control device for controlling the compression procedure and the live load to ascertain at which time to exert a live-load pressure an aspect of the invention provides that an appropriate force measuring device measures forces on the upper ram and initiates the application of the live load if the force falls below a predetermined value. Alternatively, the live load may be initiated if an appropriate path measuring device ascertains that the upper ram has reached a predetermined position. Path measuring devices in such presses are known as such.

Various constructional versions are imaginable to bring about the application of a live load in a hydraulic press. With this in view, an aspect of the invention provides for the upper press cylinder to act onto the upper ram via first and second guide plates between which pressure columns are arranged, which pressure columns are mounted on the second guide plate so as to be supported on the second guide plate during the press stroke and to be lifted by a limited length with respect to the second guide plate until carrying along the second guide plate during a return stroke.

DETAILED DESCRIPTION OF THE INVENTION

Figure 1:
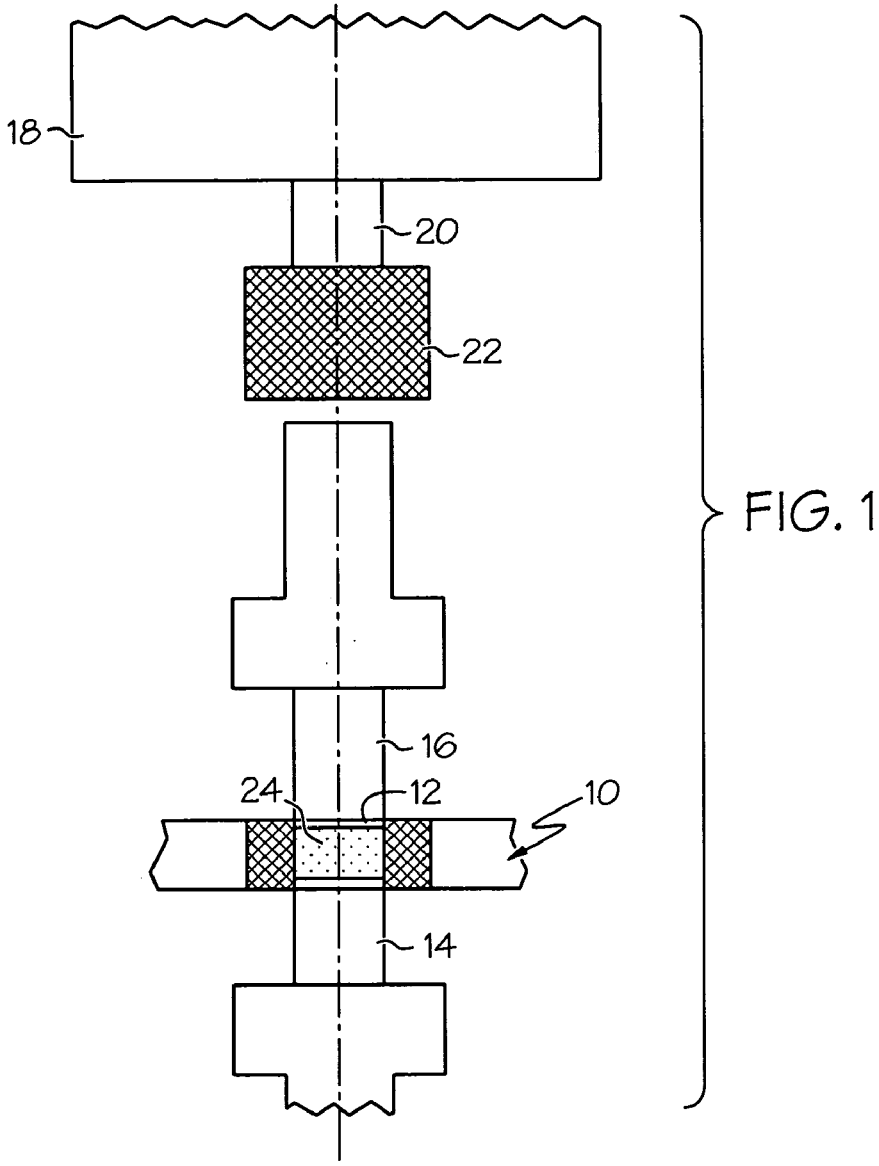
FIG. 1 extremely schematically shows some part of the inventive powder press.

While this invention may be embodied in many different forms, there are described in detail herein a specific preferred embodiment of the invention. This description is an exemplification of the principles of the invention and is not intended to limit the invention to the particular embodiment illustrated Referring to FIG. 1, a die-plate is shown at 10 having a die-bore 12 with which a lower ram 14 and an upper ram 16 are associated. An upper hydraulic press cylinder which actuates a press slide 20 is outlined at 18. An assembly 22 by which a live load can be purposefully applied to upper ram 16 is provided between press slide 20 and upper ram 18 when press slide 20 is reversed to effect a return stroke after the final position or maximum force is reached. During the first length of return stroke, the compact 24 will spring back within the die-bore 12, thus following upper ram 16. The result is a characteristic line run in the force-path diagram of FIG. 2 that is designated by 26. If no further measures are taken the characteristic line continues up to a zero force via the phantom-line branch 28. As set forth previously, however, such a relief of the compact from pressure is disadvantageous because it causes undesirable cracks to occur in the compact. Thus, assembly 22 which also measures the force exerted onto upper ram 16 also determines at which time a minimum force is reached at 30. At this time, a separate force generator not shown in FIG. 2 assumes loading upper ram 26, leading it to zero along characteristic line branch 32 while upper ram continues to move. It is understood that the length illustrated in FIG. 2 is only very short and is merely a few millimeters.

Figure 2:
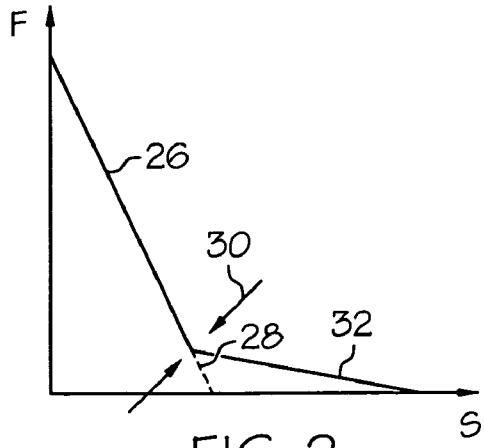
FIG. 2 shows a force-path diagram of the force acting on the compact at the beginning of the return stroke of the upper ram of the powder press.
Figure 3:
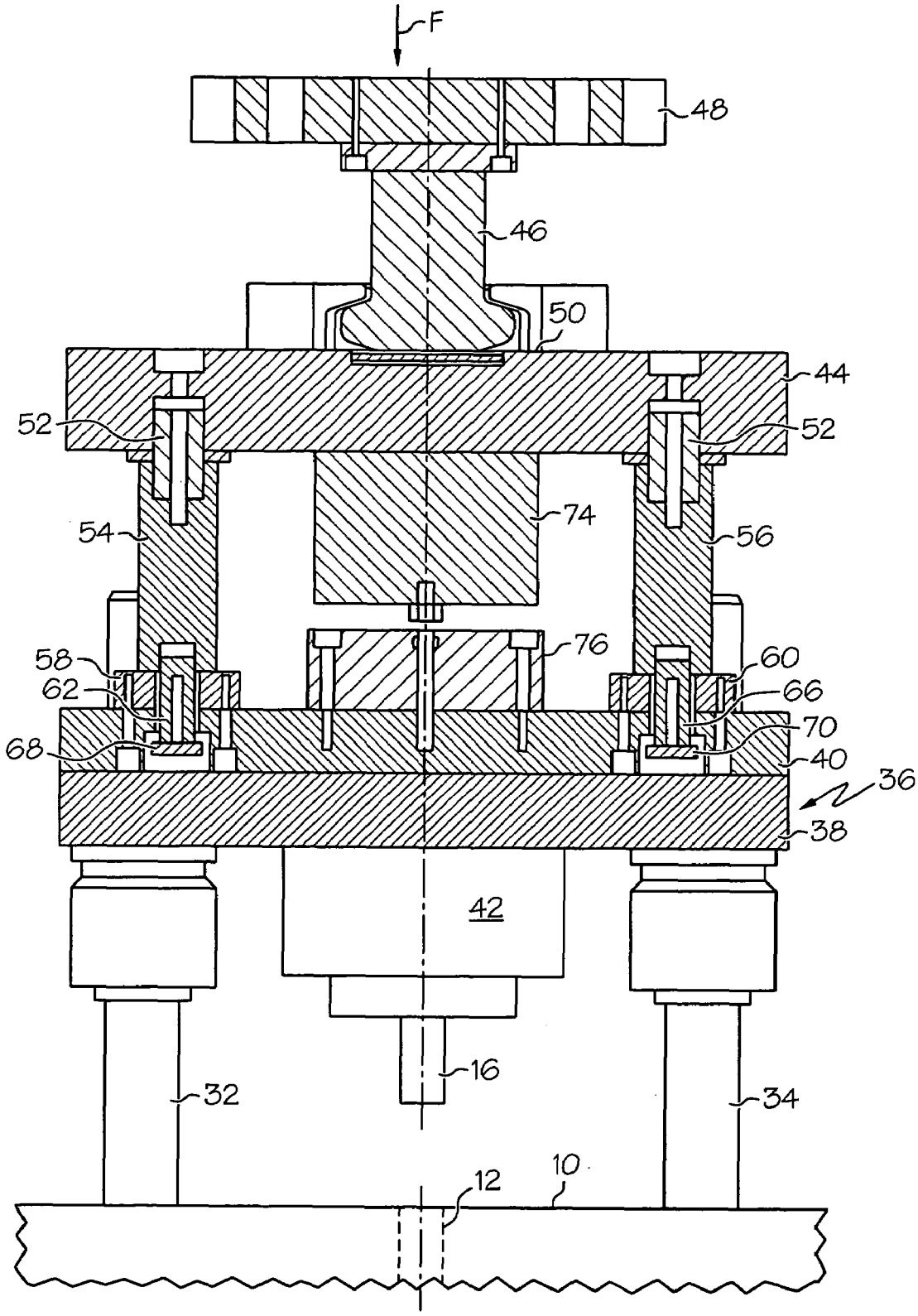
FIG. 3 schematically shows the constructional setup of the upper region of an inventive powder press.

FIG. 3 represents a possible constructional setup of the press of FIG. 1. Parts which are the same as those of FIG. 1 are given the same reference numbers.

The die-plate 10 has arranged thereon guide columns 32, 34. They guide a plate assembly 36 having a lower plate 38 and an upper plate 40. Plate assembly 36 defines a lower guide plate. Upper ram 16 is connected to plate 38 via a component 42 which is not referred to in detail.

An upper plate 44 is connected to the slide (not shown) of the press cylinder via a ram 46 and a distance plate 48. Ram 46 acts onto a separate thrust plate 50 which is embedded in a recess of upper guide plate 44.

Pressure columns 54, 56 are connected to the lower side of guide plate 44 by means of pins 52. At the lower end, pressure columns 54, 56 are supported on sleeves 58, 60 which, in turn, are bolted to the upper side of plate 50. Pins 62, 66 are passed through bores of sleeves 58, 60 and are bolted into blank bores at the lower end of pressure columns 54, 56. Pins 62, 66 have flanges 68, 70 which interact with the lower side of sleeves 58, 60 when pins 62, 66 are lifted.

Connected to the lower side of upper guide plate 44 is a pneumatic cylinder 74. The upper side of plate 40 has connected thereto a load cell 76. Pneumatic cylinder 74 is capable of exerting a pressure onto load cell 76 that is transferred to plate assembly 36 and, hence, upper ram 16.

It is understood that not only two guide 32, 34 and two pressure columns 56, 56 are provided, but at least four each which may be arranged at a square.

During the normal compression procedure, the press cylinder which is not shown exerts a pressure on distance plate 48 in a way shown by arrow F, which has a direct effect on upper ram 16. Upper ram 16 is introduced into die-bore 12 and performs the compression procedure in a known manner until it reaches a predetermined position or has applied a predetermined force. Subsequently, the press cylinder is acted on and displaced in the opposed direction. As soon as the dead centre is reached for the press cylinder and upper ram or also a short time afterwards pneumatic cylinder 74 also exerts a force onto the ram via load cell 76. A return stroke motion of the upper press cylinder, however, does not immediately cause upper ram 16 to be carried along, which lasts up to a point where flanges 68, 70 strike at the lower side of sleeves 58, 60. In the condition drawn, the spacing is about 3 to 4 mm between flanges 68, 70 and sleeves 58, 60. Thus, as soon as the press cylinder begins its return stroke the compact is relieved of pressure with the compact, however, still applying a counter-force to upper ram 16 as before until this force becomes equal to the force of pneumatic cylinder 74. When the return motion continues the force applied to the lower ram by the pneumatic cylinder is maintained and will be reduced to zero according to a predetermined characteristic line, i.e. in a manner by which an optimum live load is achieved on the compact and avoids cracking or the like in any case. When the press cylinder has overcome the gap between flanges 68, 70 and sleeves 58, 60 upper ram will now be lifted, after which pneumatic cylinder 74 is no longer able to exert any force on upper ram 16.

The above Examples and disclosure are intended to be illustrative and not exhaustive. These examples and description will suggest many variations and alternatives to one of ordinary skill in this art. All these alternative and variations are intended to be included within the scope of the attached claims. Those familiar with the art may recognize other equivalents to the specific embodiments described herein which equivalents are also intended to be encompassed by the claims attached hereto.

What is claimed is:

1. A hydraulic press for compressing metallic powder or the like to form compacts, comprising a die-plate, an upper ram, and at least one lower ram which interact with a die-bore and are operable each by a dual-action hydraulic press cylinder, a limited dead path length being provided for the return stroke in the force path between the press cylinder and the upper ram, in which path the upper ram is not carried along, and a separate pressure generator producing a variable pressure being arranged in parallel with the force path via which a compression force is produced on the upper ram during the dead path length, the separate pressure generator acting on the upper ram through a second force measuring device, a control device which actuates the separate pressure generator if the force measured by the second force measuring device is below a predetermined value or the hydraulic cylinder of the upper ram, respectively, has reached a predetermined position during the return stroke, the position being measured by path measuring means, and a force-path curve being stored in the control means along which the force of the separate pressure generator is acting on the upper ram when the upper ram starts the return stroke.

2. The hydraulic press as claimed in claim 1, characterized in that the separate pressure generator acts on the upper ram via a first force measuring device.

3. The hydraulic press as claimed in claim 1, characterized in that the separate pressure generator preferably is a dual-action pneumatic cylinder (42).

4. The hydraulic press as claimed in claim 1, characterized in that the press cylinder acts on the upper ram (16) via a first guide plate (44) and a second guide plate (36) between which pressure columns (54, 56) are arranged, which pressure columns (54, 56) are mounted on the second guide plate (36) so as to be supported on the second guide plate (36) during the press stroke and to be lifted by a limited length with respect to the second guide plate (36) until carrying along the second guide plate (36) during a return stroke.

5. The hydraulic press as claimed in claim 3, characterized in that a pneumatic cylinder (74) is arranged at the lower side of the first guide plate (44) and a load cell (76) is arranged at the upper side of the second guide plate (36).

* * * * *